US006389944B1

(12) United States Patent
Davidson

(10) Patent No.: US 6,389,944 B1
(45) **Date of Patent: *May 21, 2002**

(54) BAGEL HOLDER

(75) Inventor: Jimmy W. Davidson, Woodbury, MN (US)

(73) Assignee: Larand International, Incorporated, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,813

(22) Filed: Sep. 21, 1998

Related U.S. Application Data

(63) Continuation-in-part of application No. 08/958,035, filed on Oct. 27, 1997, now abandoned.

(51) Int. Cl.[7] ..... B26D 7/01

(52) U.S. Cl. ..... 83/762; 83/932; 30/114; D7/673

(58) Field of Search ..... 83/762, 870, 932; D7/673; 30/114

(56) References Cited

U.S. PATENT DOCUMENTS

| | | | | | |
|---|---|---|---|---|---|
| D85,385 | S | | 10/1931 | Lowitz | D7/673 |
| 1,871,713 | A | | 8/1932 | Lowenthal | D7/673 X |
| 2,089,980 | A | | 8/1937 | Owen | D7/673 X |
| 2,792,866 | A | | 5/1957 | Leal | 146/218 |
| 3,018,806 | A | * | 1/1962 | Moore | 83/762 X |
| 3,347,296 | A | * | 10/1967 | Rothman | D7/673 X |
| 4,131,043 | A | | 12/1978 | Colman et al. | 83/167 |
| 4,249,445 | A | | 2/1981 | Browning | 83/762 |
| 4,399,989 | A | | 8/1983 | Baillie | 269/87.2 |
| D277,445 | S | | 2/1985 | Levine | D7/43 |
| D279,156 | S | | 6/1985 | Levine | D7/43 |
| 4,550,636 | A | | 11/1985 | Josselson et al. | 83/743 |
| 4,580,343 | A | | 4/1986 | Bell, Jr. | 30/114 |
| 4,747,331 | A | | 5/1988 | Policella | 83/762 |
| 4,807,505 | A | | 2/1989 | Campbell et al. | 83/454 |
| 4,948,106 | A | | 8/1990 | Popeil et al. | 268/87.2 |
| D315,275 | S | | 3/1991 | Aziz et al. | D7/673 |
| D316,657 | S | | 5/1991 | Mulherin | D7/673 |
| D330,315 | S | | 10/1992 | Shved | D7/673 |
| D343,770 | S | | 2/1994 | McFarling et al. | D7/673 |
| 5,361,666 | A | | 11/1994 | Kensrue | 83/870 |
| D354,203 | S | | 1/1995 | Naccarato | D7/673 |
| 5,386,755 | A | | 2/1995 | Schneider et al. | 83/762 |
| 5,431,078 | A | | 7/1995 | Ricard et al. | 83/870 |
| 5,481,953 | A | * | 1/1996 | McLeod | 83/762 |
| 5,673,608 | A | * | 10/1997 | DeMars | 83/762 X |
| 5,715,736 | A | | 2/1998 | Cherney | 83/13 |
| 5,718,158 | A | | 2/1998 | Roggie | 83/762 |
| 5,819,629 | A | * | 10/1998 | Sarich | 83/762 X |
| 5,903,982 | A | * | 5/1999 | Gibson | 30/114 X |
| 5,927,701 | A | * | 7/1999 | Chapman | 269/87.2 |
| 6,145,427 | A | * | 11/2000 | Smith | 83/932 X |

* cited by examiner

*Primary Examiner*—M. Rachuba
*Assistant Examiner*—Charles Goodman
(74) *Attorney, Agent, or Firm*—Westman, Champlin & Kelly, P.A.

(57) ABSTRACT

A bagel holder is a saddle shaped member having a top wall and depending side walls that will hold a bagel. A knife guide is provided adjacent the top wall, and is formed by two spaced apart walls that define a knife slot and have lower edges that are concave to receive a peripheral portion of a bagel that is positioned between the side walls. A knife is then inserted in the slot while the bagel is rested on a supporting surface to cut the bagel into two pieces. Holder wall edges which will engage the outer surface of the bagel and keep it from rotating are provided.

11 Claims, 6 Drawing Sheets

66
64A
64A
64
79
79
60
70
76
66
84
62
70
84B
72
72
73
73

BAGEL HOLDER

CROSS REFERENCE TO RELATED APPLICATION

This is a continuation-in-part of U.S. patent application Ser. No. 08/958,035, filed Oct. 27, 1997, now abandoned.

BACKGROUND OF THE INVENTION

The present invention relates to a holder that has a top wall and spaced side walls which slip over a bagel or similar food item and which is used for holding an exposed portion of the bagel against a cutting board or supporting surface while a knife is inserted in a provided knife guide under the top wall and the bagel is sliced by moving the knife back and forth and downwardly toward the supporting surface. The bagel is kept from moving or rotating by downward force on the holder.

Various cutting stands have been advanced for supporting bagels, loaves of bread, or other food items and while providing a guide for a knife that will do the slicing. The food item needs to be securely gripped and in a position where the knife can be easily inserted and sliced through the food item. Positively guiding the knife that is doing the slicing is desired, and the ability to securely hold the food item, in particular a bagel, is needed.

The prior food slicers work, but are at times awkward to use since most have no ability to simultaneously hold and cut without putting fingers and hand at risk. Further, most holders on the market do not have a way of keeping the bagel from rotating when the knife is started. The hard crust and dense center cause a likelihood of rotation. Many of the holders position a bagel with the top of the bagel protruding from the top so the start of the cut is completely arbitrary and the end of the cut is against the base of the holder, causing shortened useful life of the holder and the knife edge.

SUMMARY OF THE INVENTION

The present invention relates to a saddle like holder for a bagel that slips over a bagel and can be gripped with one hand. The holder has a top wall and a pair of spaced, depending side walls that receive the bagel. The outer surface of the top wall is configured to fit in the palm of a hand that is using the holder, and a suitable knife guide and bagel stop is provided on the interior of the holder, near the top wall. The length of the side wall is such so that when a bagel is positioned against the bagel stop, and is between the side walls, a portion of the bagel extends out of the holder, below the side walls. The exposed end of the bagel is placed on a cutting board and can be held down with the palm of the hand bearing on the top wall. The bagel stop supports the top of the bagel spaced from the top wall so the knife can be inserted into the guide above the bagel and the bagel can be cut in back and forth, downward strokes. The knife guide is formed by two parallel walls that have concave lower edges that form the bagel stop to hold the bagel away from the underside of the top wall so a knife can be inserted easily.

Bagel grips are provided on the interior of the holder to hold the bagel from rotating when the knife is slid back and forth. In a preferred form, narrow holder walls extend in from the side walls a short distance, so the bagel can be inserted easily, but when gripped, the side walls flex together or inwardly and the holder wall edges press into the bagel. The holder walls are of a length and vertical direction that is less than the diameter of the bagel ring, so that the holder walls do not grip the bagel in the center hole portion or in the lower portion of the ring which is resting on a cutting surface.

The lower edges extend around the periphery of the bagel a sufficient distance to prevent the bagel from rotating when the holder is pressed onto the bagel and the bagel is cut.

The lower edge of the knife guide walls extend around the bagel periphery sufficiently so that the knife is guided through almost 50% of the bagel. The knife is safely operated by using the guide below the top wall and cutting away from the hand toward a cutting board. The side walls are sufficiently large so that the finger and thumb of the hand gripping the bagel holder do not extend beyond the lower ends of the side walls. Also, the top wall is concave so a hand will tend to center and not slip over the ends of the wall into the path of the knife.

The holder walls provide the preferred way of positively holding the bagel, and also, the holder walls extend to engage and support the knife guides to prevent them from separating.

The bagel holder can be made of a suitable plastic material that can be injection molded, and which provides for some resiliency of the side walls so a slight squeeze force can be placed on the bagel. The holder can be readily cleaned after use.

DETAILED DESCRIPTION OF THE PREFERRED EMBODIMENTS

Figure 2:
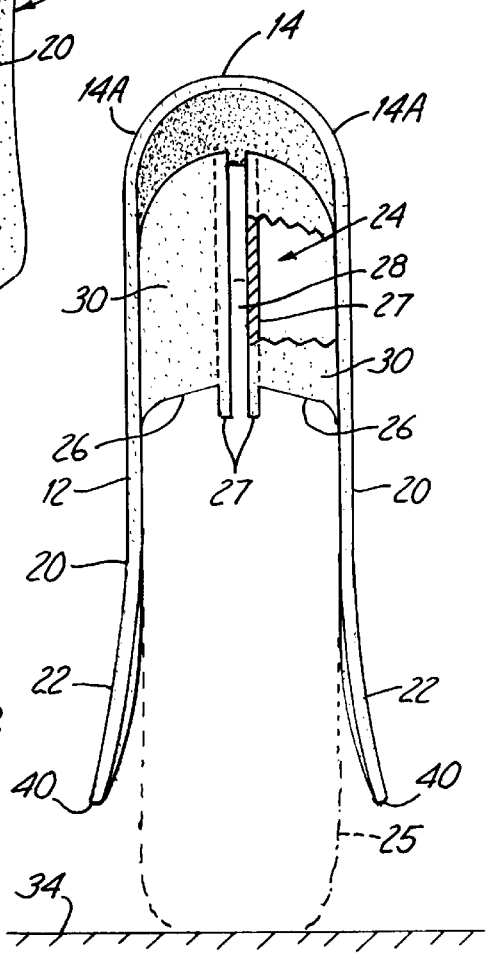
FIG. 2 is an end view of the holder of FIG. 1.
Figure 3:
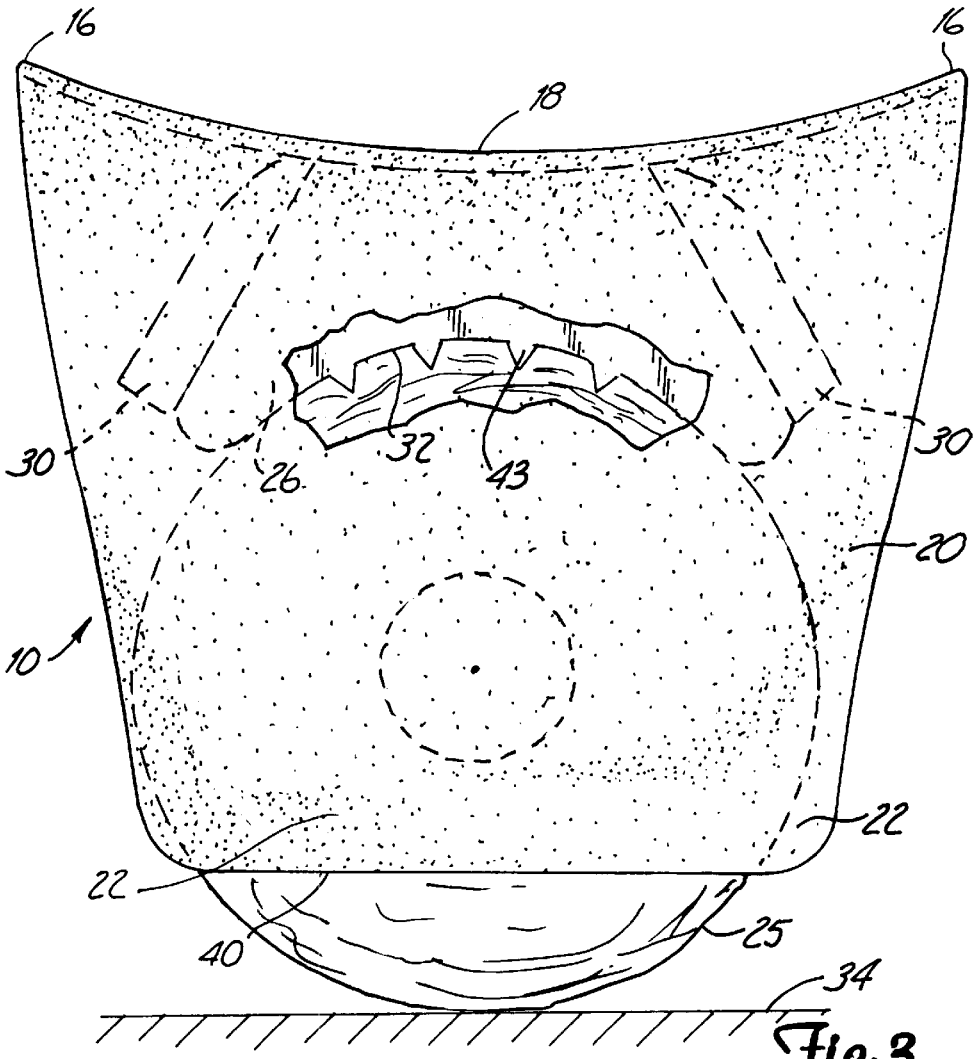
FIG. 3 is a side view of the holder shown in FIG. 2.
Figure 4:
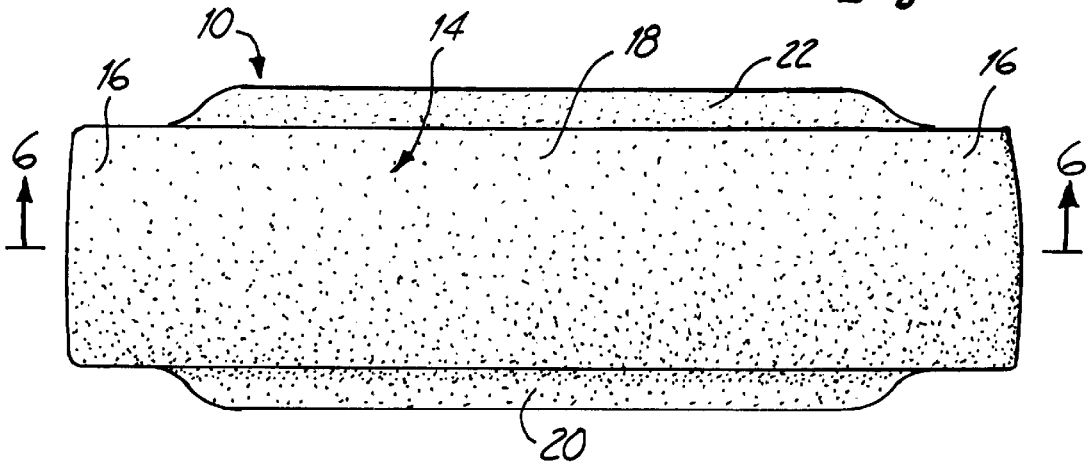
FIG. 4 is a top view of the bagel holder.
Figure 5:
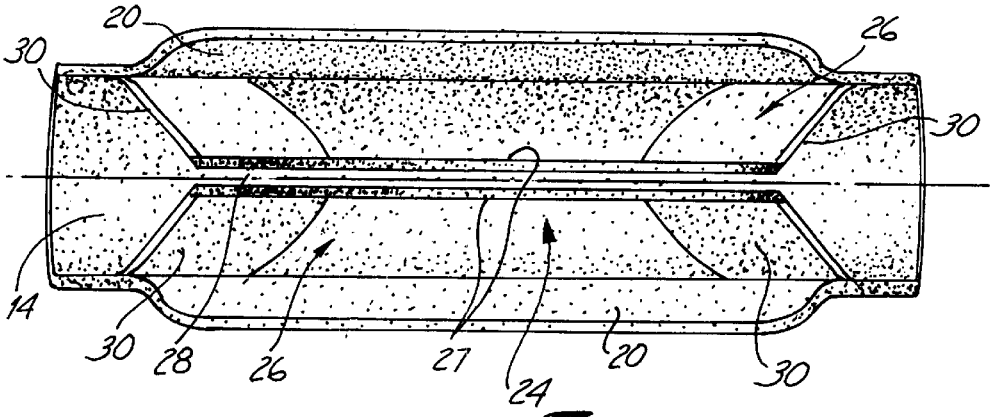
FIG. 5 is a bottom view of the bagel holder.

The bagel holder of a first form of the invention illustrated generally at 10 as shown is a molded saddle like shell 12 that has a top wall 14. The top wall is formed into a concave curved surface, as shown in FIG. 3, having raised ends 16 and a gently curved smooth concave center portion 18. The top wall 14 is molded to have rounded side edges shown at 14A in FIG. 2, that join spaced, depending side walls 20. The side walls 20 are generally planar, and flare outward at the lower ends 22 and also flare out along the front and rear edges at least near the lower edges of the side walls. The flared ends guide a bagel as it is inserted. Also the flares at the lower and front and rear edges provide a tactile feel for the fingers to sense when they are approaching the limits of the walls.

Figure 1:
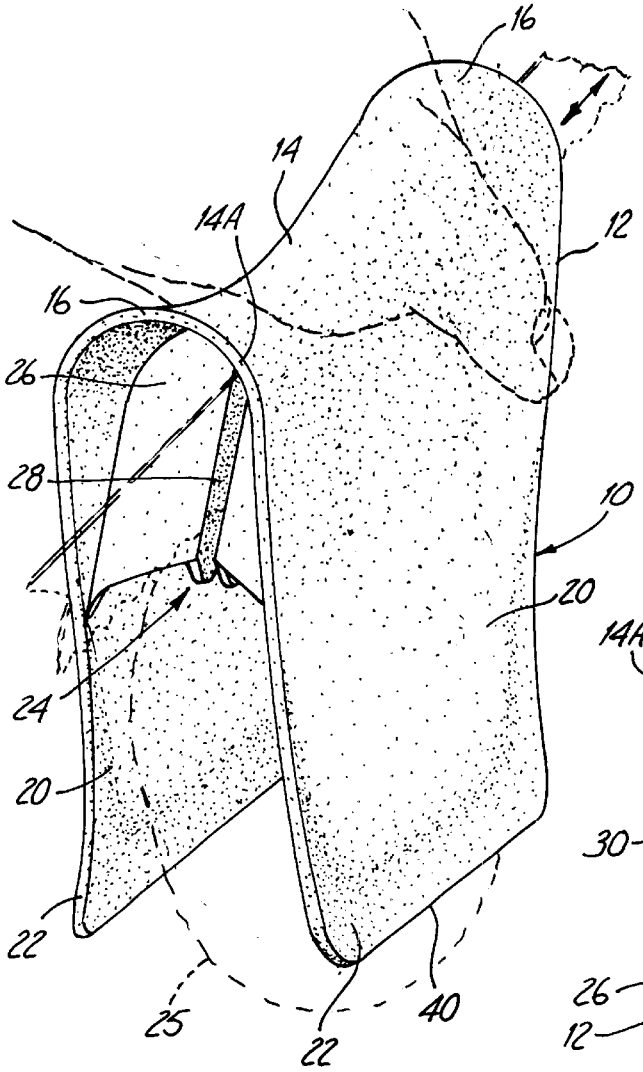
FIG. 1 is a perspective view of a bagel holder made according to the present invention.
Figure 6:
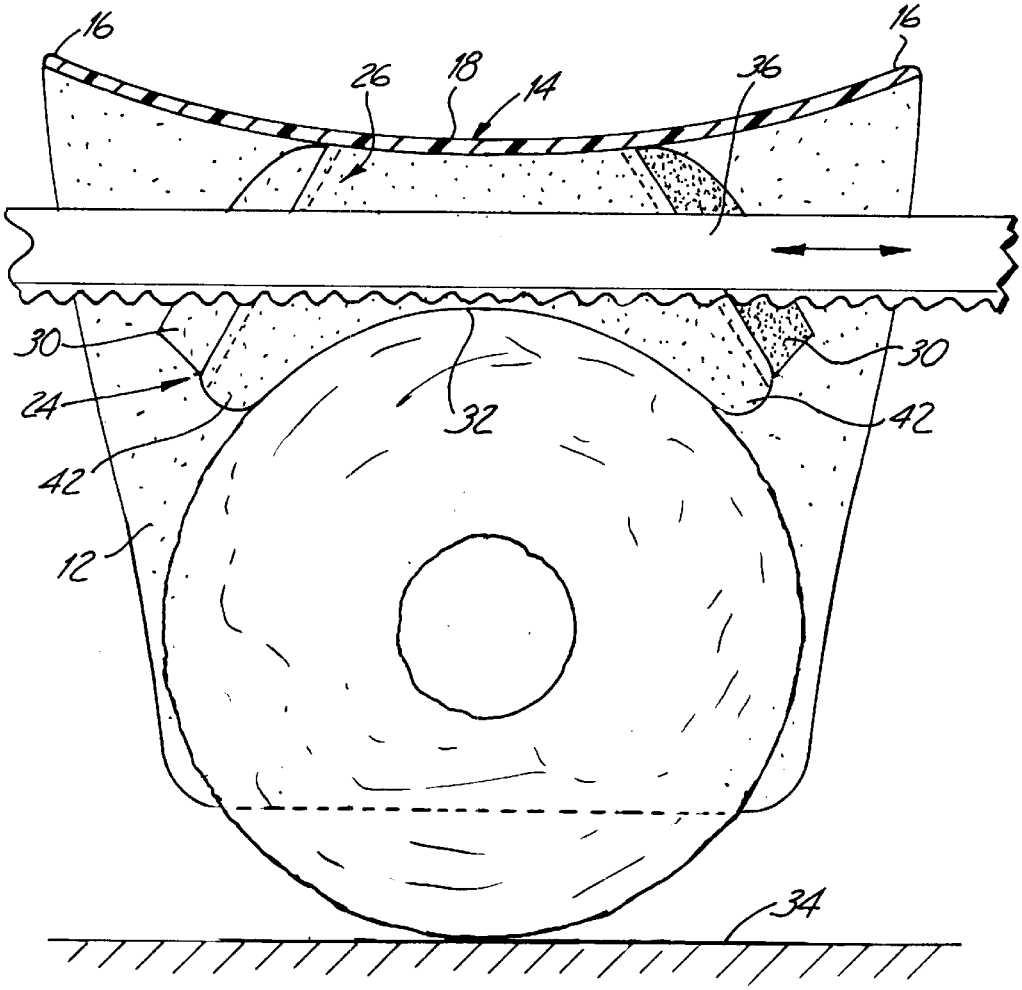
FIG. 6 is a sectional view taken along line 6—6 in FIG. 4.

The top wall 14 is of length to insure that a human hand, such as that shown in FIG. 1, is shorter than the space between the ends 16. The side walls 20 are of fore and aft length that is greater than the diameter of a standard bagel 25 shown in dotted lines in FIGS. 1 and 2 and in solid lines in FIGS. 3 and 6.

The knife guide and bagel rest or support indicated generally at 24 is formed on the interior of the bagel grip between the side walls 20 and below the top wall 14. The knife guide and bagel support 24 is formed by a pair of members 26, each of which is fixed to a separate one of the side walls 20. The guide members 26 are supported back to the top wall 14, and define a slot 28 between solid vertical walls 27. Gussets or braces 30 at the opposite ends of walls 27 brace the walls 27 back to the side walls 20 and form tapered wall guides for guiding a knife being inserted into the slot 28 formed by walls 27.

The walls 27 have concave curved lower edges 32 that are of size to fit over an upper portion of the periphery of a standard bagel 25. The curved lower edges 32 form a receptacle or support for a bagel between the side walls 20. The curved edges keep the bagel from sliding out the end or rolling when being cut. The top wall of the holder can be pressed down so that the bagel is held against a cutting board or other supporting surface shown at 34. Then, because the curved edges 32 and thus the top of the bagel are spaced from the lower side of the top wall 14 and in particular the center portion 18, a knife blade shown at 36 can be slid into the space above the bagel through the slot 28.

With one hand, such as the left hand as shown in FIG. 1, resting on the top wall 14 between the raised corners 16 and pressing the bagel against the cutting board, the other hand can be used for inserting the knife blade 36 and then slicing the bagel 25, by back and forth and downward strokes as guided by the guide walls 27. Once the bagel has been penetrated with the knife edge, further cutting is relatively easy, because the bagel can be held securely while the cutting takes place.

The lower flared portions 22 of the side walls, and the particularly lower edges 40 are spaced from the curved support surface 32 of the walls 27 such that the bagel protrudes from the bagel holder and can be pressed against a cutting board surface 34 during cutting. Also, the portion of the bagel extending out beyond the lower edges 40 can be gripped after cutting so the bagel is easily removed from the holder.

The hand on the holder is kept clear of the cutting knife blade because the curved top wall 14 protects the hand and shields it from the knife blade. The raised ends 16 keep the hand in the concave center portion of the wall. The knife tip also is constrained by the guide walls 27 and top wall 14 and does not stray toward the holding hand, by being tilted during cutting. The concave edges 32 also keep the hand a safe distance from the cutting blade, and the side walls 20 are sufficiently long in vertical direction (in direction away from wall 14) so that the finger tips do not extend beyond the lower edges 40. The self-centering slot 28 are made by continuous walls 27 so that the knife slides easily into the slot for positioning, and the entire knife blade can be inserted without contacting the bagel. The edges 32 support the bagel sufficiently far from the inner surface of the top wall 14 to provide knife clearance. The slot 28 is always in the middle of the inserted bagel when the bagel is between the side walls, since the bagel tends to self center so cutting half a bagel also can be accomplished quite easily. The ends 42 of walls 27 extend down sufficiently so that the blade of the knife is guided for a substantial distance through the bagel during the cutting.

Figure 7:
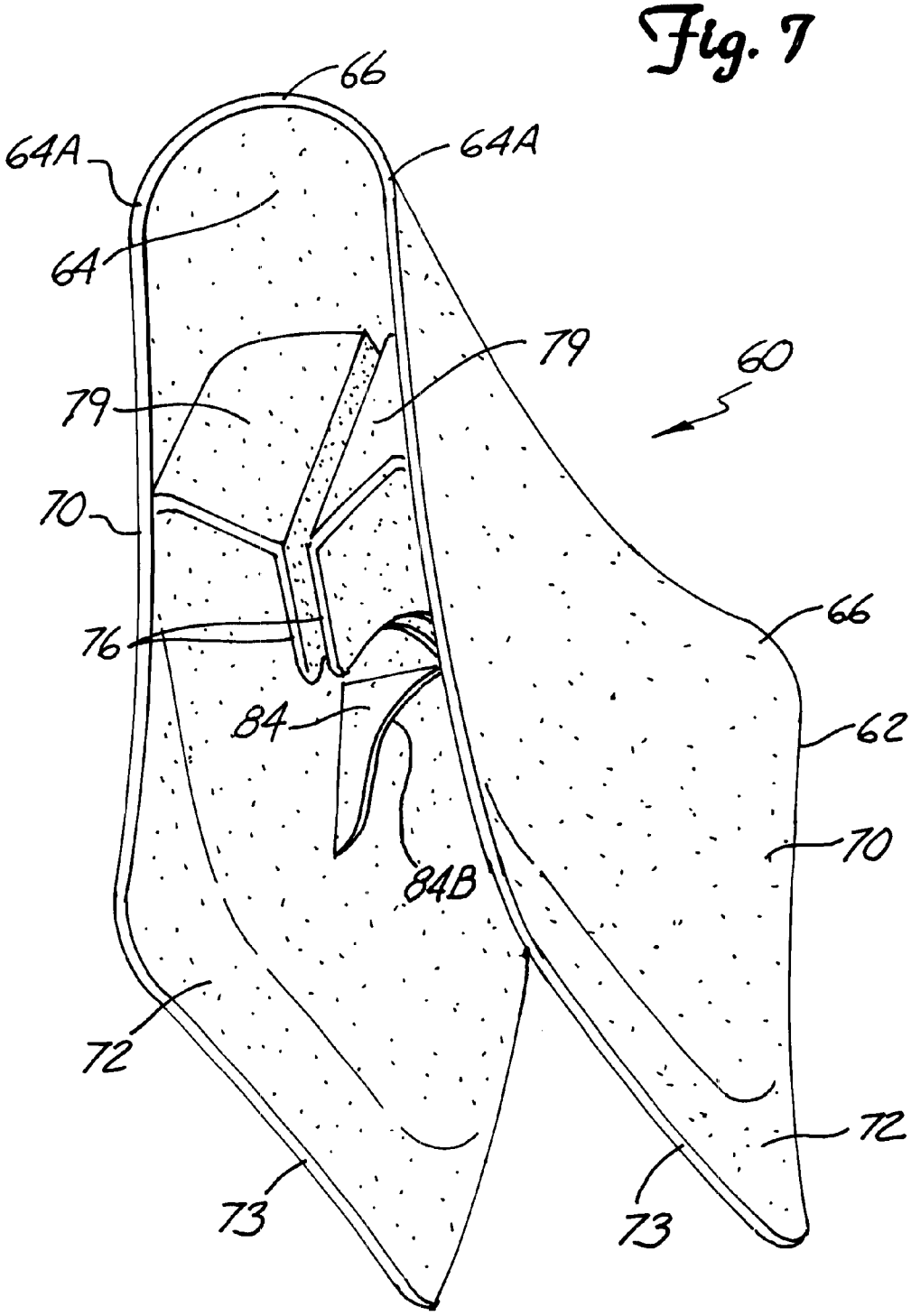
FIG. 7 is a perspective view of a preferred form of the bagel holder of the present invention.
Figure 8:
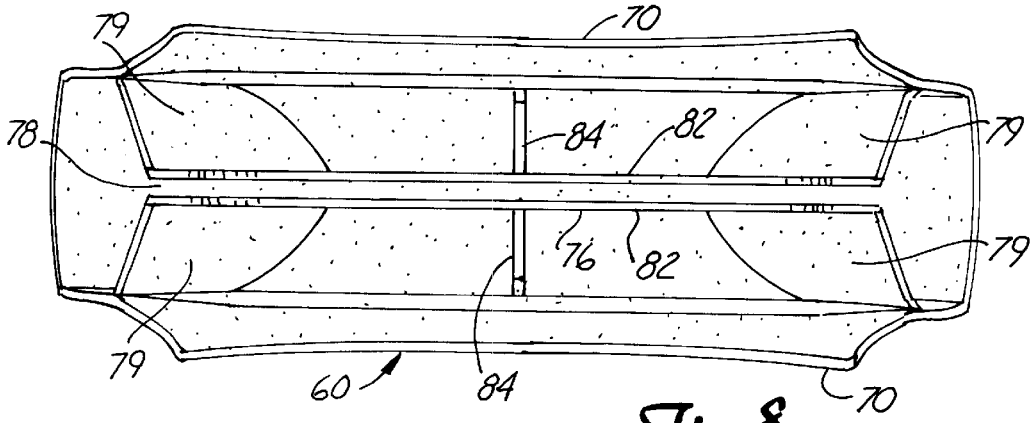
FIG. 8 is a bottom plan view of the holder in FIG. 7.

FIGS. 7–11 show a modified preferred form of the invention, comprising a second form of the bagel holder indicated generally at 60 which is also molded in a saddle shaped-like shell 62 that has a curved top wall 64. The wall 64 has raised ends 66, 66 that are gently curved so that the center portion 68 is lower than the ends. Further, the wall 64 has rounded corners as shown in FIG. 7 at 64A so that the bagel holder 60 is smoothly formed. The corners 64A join the top wall 64 to downwardly extending side walls 70, 70 which flair out at the lower ends 72, 72 provided "tactile" feel for the user, to sense if the fingers tend to extend downwardly toward the lower ends 73 of the side walls. The length of the top wall 64 is selected as shown in the previous form of the invention, so that a human hand will grip the shell naturally and hold it cradled with the fingers on one side and the thumb on the other.

Figure 9:
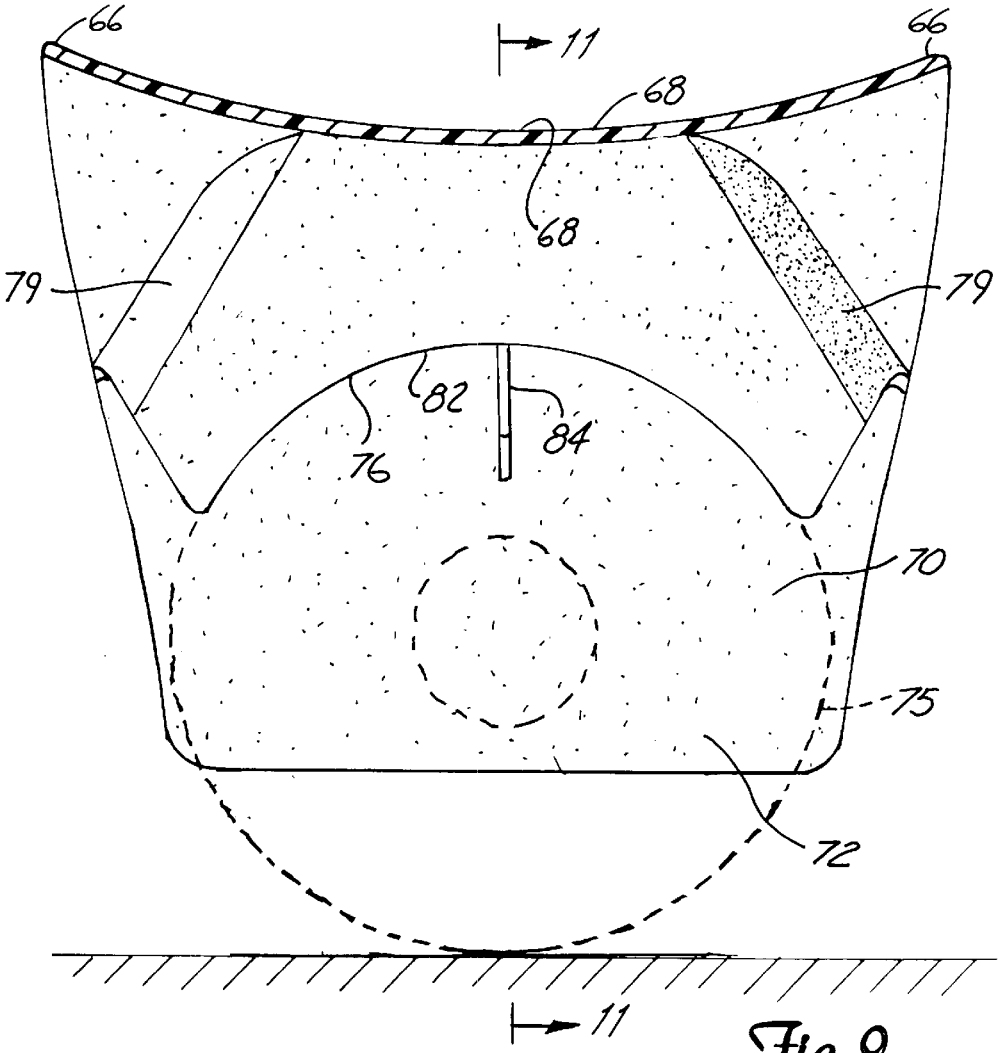
FIG. 9 is a vertical sectional view of the holder of FIG. 7.
Figure 10:
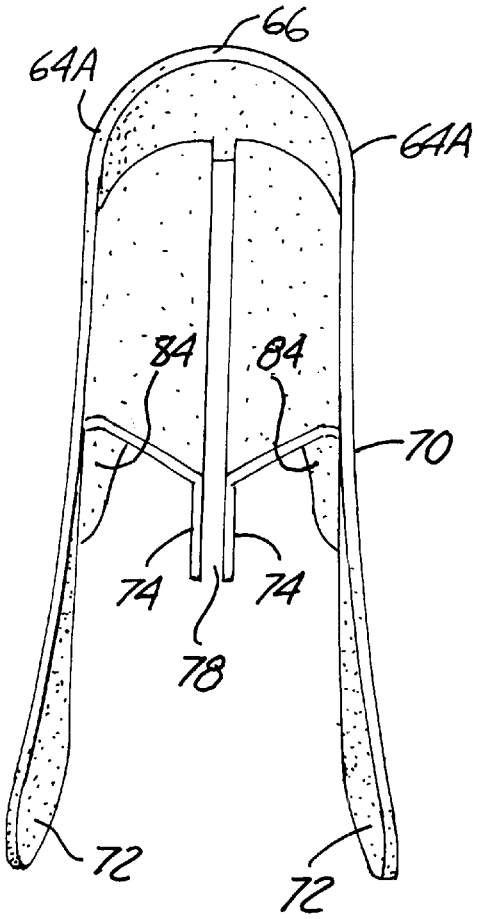
FIG. 10 is an elevational view of the device of FIG. 7.

The side walls 70 are also shorter in length than a standard bagel as shown, with a portion of the bagel shown at 75 in FIG. 9 in dotted lines.

A bagel rest and support 76 is positioned between the side walls 70, 70 and below the top wall 64 and as in the previous form of the invention, there are knife side guide walls 74, that are joined at the upper ends of the top wall 64 when molding, and have outer end portions 79 that flare to the side walls 70 adjacent the fore and aft ends of the bagel holder. The end portions 79 are molded to the respective side walls 70. The wall 74 has lower ends that define a slot 78 between them which is of size to receive a knife for cutting a bagel, as shown in the first form of the invention. The lower ends of the guide walls 74 are planar, and define curved lower edges 82, 82 which are smooth edges and against which outer surface of the bagel shown at 75 will rest when the bagel is placed into the bagel holder. The curved lower edges form a receptacle or support for supporting the bagel in place. The space between the edges 82 and top wall 64 is shown in FIG. 11, and provide adequate space to insert a knife before starting the cut, so the knife is always properly guided during the start of the cut and curing most of the cutting strokes.

Figure 11:
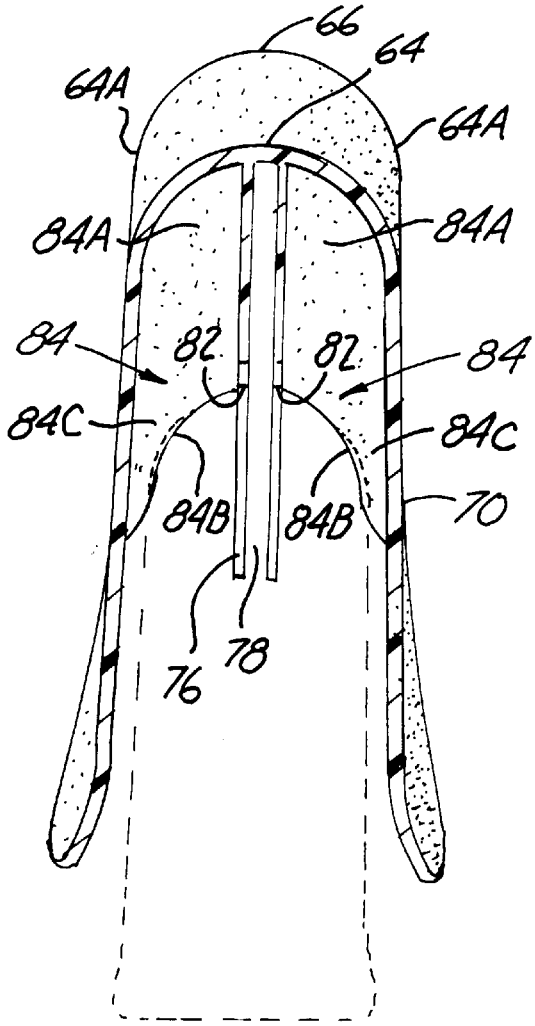
FIG. 11 is a sectional view taken as on line 11—11 in FIG. 9.

In this form of the invention, the bagel holder is formed with holder walls or ribs 84 which are molded integrally with each of the side walls 70, as perhaps best seen in cross section in FIG. 11. These holder walls are in the mid-portions of the bagel holder, that is in the center portion with respect to fore and aft direction. The holder walls 84 serve several purposes. The primary purpose is to keep the partially sliced bagel from creeping up into the upper portion of the bagel holder as downward pressure is exerted. In the upper portion of the wall 84, they support and reinforce the knife guide wall 74 relative to the side walls 70. This also can be seen in FIG. 7 where the upper portions are indicated at 84A. Below the edges 82 of the knife guide walls 74, the holder walls 84 are curved along end edge surfaces 84B, 84B so that they will fit over the top of a bagel. The lower end wall portions 84C are molded back integrally with the side walls 70.

The end edges 84B of the guide wall sections 84 are formed to be concave, as shown, with a radius that extends for substantially 80° or more of arc.

It can thus be seen that when a bagel is placed between the side walls 70, 70, it is engaged not only by the curved wall edges 82 which extend in fore and aft direction, but also by the curved edges 84B of the holder walls 84. The holder then can be squeezed inwardly so that the side wall 70, 70 move together, and as indicated in dotted lines in FIG. 11, the edges 84B will move inwardly from their rest position. Edges of walls 84 grip the bagel securely and hold it in place. The lower portions of the wall 70, 70 can be deflected inwardly and hold the side walls of the bagel as well, but the resistance to rotation when cutting is obtained by the narrow wall end edges of holder walls 84 embedding into the bagel along the upper portion and partially along the sides.

The holder walls 84 terminate substantially above the center hole of a bagel, as illustrated in FIG. 9, so that there isn't any mark or imprint on a substantial portion of the bagel.

Thus, the second form of the invention has a modified wall structures for holding the bagel using narrow wall end edges that are perpendicular to the plane of the bagel and which can be moved inwardly by squeezing the side walls of the bagel holder to grip the bagel securely.

The knife is guided into the slot 78 as previously shown, and the molded walls are sufficiently flexible so that they can be squeezed together manually for the cutting operation, but are not squeezed so tightly that they will cause the knife to stick or jam.

The space between the side walls 20 or 70 can be reduced by squeezing the holder, so that smaller size bagels can be held, and the walls can also separate a greater amount than their "at rest" position for thicker bagels. The bagel holder is small for easy storage, and it is easy to clean by hand or in a dishwasher and can be used by either right or left-handed users.

The concave curved edges 32 and 82 of course are narrow because the guide walls are thin, but together the edges provide adequate support for a bagel so that it will be held in position and not slip out of place during the cutting strokes.

The curvature of the top walls 14 or 64 can be made more or slightly less, and the ends 16 or 66 can be tilted up more sharply to form stops for retaining the hand in position. The side walls also can be made slightly shorter than those shown, but the walls should provide a barrier between the holding hand and the knife.

While the word "bagel" has been used throughout this description, other food items, such as buns, rolls or donuts can be sliced in the same manner.

The bagel holder of the present invention has the saddle directed down with the bagel on a surface, and the cutting is away from the hand, not toward the hand. The cutter guide of the present invention permits the knife to be inserted and located or guided before cutting starts, so the cut is properly located.

The cut is always made away from the hand and wrist. By pushing down on the bagel while cutting, the bagel is held in place and the hand is nowhere near the cutting edge of the blade. The hand is separated from the knife by the walls and is out of the cutting path.

While not shown, the top wall can have cross ribs or ridges to provide a less smooth gripping surface.

Although the present invention has been described with reference to preferred embodiments, workers skilled in the art will recognize that changes may be made in form and detail without departing from the spirit and scope of the invention.

The walls 74 can be terminated short of the top wall 64 and the upper portion of the walls angled over the wide walls so there would be a space above the walls 74 in such form.

What is claimed is:

1. A hand held holder for a food item to be sliced comprising a generally U-shaped frame having a top wall with a longitudinal length and depending generally parallel flexible side walls, said flexible side walls being spaced apart a selected distance and having an opening at one end of the holder opposite from the top wall to receive the food item therebetween, and a knife guide mounted adjacent the top wall, said knife guide comprising spaced guide side walls defining a knife guide slot centered between the depending generally parallel flexible side walls, a pair of holder walls perpendicular to the flexible side walls and integral therewith and extending inwardly from the flexible side walls to the guide side walls, the holder walls having narrow edges that face each other and which are spaced apart to receive the food item, the knife guide slot being open at a first end thereof adjacent to and facing the top wall, the knife guide spaced guide side walls having end edge surfaces facing the opening at the end of the holder opposite the top wall to engage a food item periphery, the flexible side walls being compressible together such that the holder walls engage sides of the food item seated against the end edge surfaces, the end edge surfaces being spaced from the top wall to define a space between the top wall and the periphery of the food item seated against the end edge surfaces of the knife guide spaced guide side walls, the space between the top wall and the periphery of the food item permitting a knife to be inserted between the food item seated on the end edge surfaces of the knife guide and the top wall so that the knife inserted in the space and moved into the knife guide enters the knife guide slot at the opening of the knife guide slot adjacent to the top wall and engages the food item and as the knife is moved away from the top wall slices the food item held in the holder as the knife is moved away from the top wall.

2. The holder of claim 1 wherein the holder walls extend from adjacent the top wall and terminate spaced from edges of the flexible side walls opposite from the top wall.

3. The holder of claim 1, wherein selected edge portions of said flexible side walls are flared outwardly.

4. The holder of claim 1, wherein said top wall is formed to have a concave upper surface.

5. The holder of claim 1, wherein said guide side walls have the end edges spaced from the top wall which are formed concave with a radius that extends for substantially 80° or more of arc.

6. The holder of claim 1, wherein said top wall is rounded in a transverse cross section and forms a concave upper surface extending from end to end.

7. A holder for a food item comprising a saddle shaped support having a pair of spaced apart side walls joined together by a top wall, said spaced apart side walls being spaced to form an opening at an end of the spaced apart side wall opposite from the top wall such that a selected food item can be placed between the side walls, a guide mounted between said side walls adjacent the top wall and defining a slot for guiding a knife below the top wall, the slot having an end open to the top wall, said guide including a pair of spaced guide walls having lower end edge surfaces spaced from the top wall for engaging the food item, a pair of holder walls mounted on said side walls and extending perpendicular to and inwardly from the side walls, and being positioned between the guide walls and the respective side walls, said lower end edge surfaces being positioned in relation to lower ends of the side walls, such that the food item is spaced from the top wall and protrudes below the lower ends of the side walls when the food item is supported on lower end edge surfaces of the guide walls, the spacing of the food item from the top wall being sufficient to receive the knife so knife enters the end of the slot open to the top wall and wherein the knife is guided in the slot to slice the food item held in the holder as the knife is moved away from the top wall.

8. The holder of claim 7, wherein said side walls can be manually flexed together for gripping the food item between the side walls.

9. The bagel holder of claim 7, wherein said lower end edge surfaces of said guider walls are concave to form recesses for receiving the food item to be sliced.

10. The holder of claim 7 wherein the holder walls have narrow end edge surfaces facing each other and forming a space to receive the food item.

11. The holder of claim 7 wherein the side walls are manually flexible to cause a space between the guide walls to be selectively reduced.

* * * * *

UNITED STATES PATENT AND TRADEMARK OFFICE

CERTIFICATE OF CORRECTION

PATENT NO. : 6,389,944 B1
DATED : May 21, 2002
INVENTOR(S) : Jimmy W. Davidson

It is certified that error appears in the above-identified patent and that said Letters Patent is hereby corrected as shown below:

Column 4,
Line 48, after "bagel." insert -- The end edges 84B of the guide wall sections 84 are formed to be concave, as shown, with a radius that extends for substantially 80° or more of arc. --

Column 4,
Cancel lines 51-53.

Column 7,
Line 1, cancel "the" (first occurrence).
Line 4, after "so" insert -- the --.

Signed and Sealed this

Twenty-sixth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,389,944 B1 
DATED : May 21, 2002
INVENTOR(S) : Thomas Dale Chase and James Joseph Hopper, II It is certified that error appears in the above-identified patent and that said Letters Patent is hereby corrected as shown below:

Column 3,
Line 33, "Inexpensive" should read -- an expensive --.

Signed and Sealed this

Tenth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,389,944 B1
DATED : May 21, 2002
INVENTOR(S) : Jimmy W. Davidson

It is certified that error appears in the above-identified patent and that said Letters Patent is hereby corrected as shown below:

This certificate supersedes Certificate of Correction issued December 10, 2002, the number was erroneously mentioned and should be vacated since no Certificate of Correction was granted.

Signed and Sealed this

Twenty-first Day of January, 2003

JAMES E. ROGAN
*Director of the United States Patent and Trademark Office*